US005466941A

United States Patent [19]

Kim

[11] Patent Number: 5,466,941

[45] Date of Patent: Nov. 14, 1995

[54] NEGATIVE ION SPUTTERING BEAM SOURCE

[76] Inventor: Seong I. Kim, 438 Andre Ave., North Vale, N.J. 07647

[21] Appl. No.: 281,480

[22] Filed: Jul. 27, 1994

[51] Int. Cl.[6] ..... H01J 27/02; H01J 27/26

[52] U.S. Cl. ..... 250/423 R; 250/423 F; 250/299

[58] Field of Search ..... 250/423 F, 423 R, 250/423 F, 423 R, 299

[56] References Cited

U.S. PATENT DOCUMENTS

| | | | |
|---|---|---|---|
| 2,261,569 | 11/1941 | Schütze | 250/423 R |
| 2,816,243 | 12/1957 | Herb | 250/423 R |
| 2,901,628 | 8/1959 | Lamb | 250/423 R |
| 4,783,595 | 11/1988 | Seidl | 250/423 R |

FOREIGN PATENT DOCUMENTS

| | | | |
|---|---|---|---|
| 0109244 | 7/1982 | Japan | 250/423 R |
| 0132033 | 5/1989 | Japan | 250/423 R |
| 0151129 | 6/1989 | Japan | 250/423 R |
| 3129652 | 6/1991 | Japan | 250/423 R |
| 4002031 | 1/1992 | Japan | 250/423 R |
| 0543306 | 8/1978 | Russian Federation | 250/423 R |

OTHER PUBLICATIONS

Smith, Vernon, Jr., "A Sputter Pig Source For Negative Ions", No. 4 May 1, 1975, pp. 497–500, Nuclear Instruments and Methods.

Zwicker, Robert D., "A Hollow Beam Prototype Of The Universal Negative Ion Source", No. 1 Nov. 1, 1975, Nuclear Instruments And Methods. pp. 43–45.

Cesium ion Transport across a solid electrolyte–porous tungsten interface, S. I. Kim and M. Seidl, J. Vac. Sci Technol. A 7 (3) May/Jun. 1989, pp. 1806–1809.

Theory Of Metal–Solid Electrolyte Interface, S. I. Kim, M. Seidl, Physics/Engineering Physics Department, Stevens Institute of Technology, Hoboken, N.J., Mal. Res. Symp. Proc. vol. 135, 1989.

Materials Research Society, pp. 95–100 Solid–state cesium ion gun for ion beam sputter deposition, S. I. Kim, Y. O. Ahn, and M. Seidl, Department of Physics, Stevens. Institute of Technology, Hoboken, N.J. 07030, Rev. Sci. Instrum. 63 (12) Dec. 1992, 1992 American Institute of Physics, pp. 5671–5673.

Sputtering negative carbon ions from cesiated graphite surfaces, A. Pargellis and M. Seidl, J. Vac Sci. Technol. A 1 (3) Jul.–Sep. 1983, 1983 American Vacumn Society, pp. 1388–1393.

*Primary Examiner*—Constantine Hannaher
*Assistant Examiner*—Virgil O. Tyler
*Attorney, Agent, or Firm*—Ohlandt, Greeley, Ruggiero & Perle

[57] ABSTRACT

A negative ion beam source includes a heated refractory metal ribbon which is positioned adjacent a beam forming electrode that is, biased to repel positive ions emitted from the metal ribbon. An extraction electrode is juxtaposed to the beam forming electrode and includes an aperture for passing a beam of positive ions generated by the metal ribbon. The extraction electrode includes a cesium chamber with openings that are directed towards the refractory metal ribbon. A heater heats the cesium chamber and causes it to expel cesium neutrals towards a surface of the refractory metal ribbon where the cesium neutrals are ionized to positively charged cesium ions. A target is displaced to one side of a perpendicular from the surface of the refractory metal ribbon and is positioned adjacent a negative ion beam forming electrode that is biased to attract the cesium ion beam and to repel negative ions produced by cesium ion bombardment of the target. A negative ion extraction electrode is positioned to another side of the perpendicular line and is biased to repel the cesium ion beam and to attract and pass negative ions formed by bombardment of the target.

8 Claims, 2 Drawing Sheets

NEGATIVE ION SPUTTERING BEAM SOURCE

FIELD OF THE INVENTION

This invention relates to ion beam sources and, more particularly, to a negative ion beam source that is rectilinearly extensible to cover a wide area.

BACKGROUND OF THE INVENTION

The prior art includes a number of procedures for depositing thin films of metals and refractory metals on both conductive and nonconductive substrates. For deposition of diamond-like carbon coatings, chemical vapor deposition and vapor phase deposition techniques are predominant. Chemical vapor deposition procedures include hot filament emission systems, plasma assisted deposition systems, plasma jet and DC arc jet systems. Each of the deposition-procedures requires that the substrate have a high temperature. The processes further employ a gas mixture with a large percentage of hydrogen. High concentrations of hydrogen often result in polymer-like hydrocarbon impurities in the films and require an addition of gases like oxygen to burn off the polymer. Vapor phase deposition procedures include carbon arc systems, sputtering and laser ablation systems. While such systems maintain the temperature of the substrate relatively low, substantial effort is required to control the properties of deposited films. Further, scale-up of vapor phase deposition processes to enable continuous deposition, requires substantial investment.

Ion beam deposition systems have become more widely used. Most such systems employ a plasma or gas discharge to generate the ion beam. Other systems bombard a target with a first ion beam to cause the production of an opposite charge second ion beam, whose ions are then deposited on a substrate. It has been determined that the use of cesium ions as the bombarding first ion source produces a high yield of opposite charge ions from metal and refractory metal targets. Solid state cesium sources have been developed for ion beam deposition systems. Kim and Seidl describe a solid source of $Cs^+$ ions in "Cesium Ion Transport Across A Solid Electrolyte-Porous Tungsten Interface", Journal of Vacuum Science Technology A7(3), May/June 1989, pages 1806–1809, and "A New Solid State Cesium Ion Source", General Applied Physics 67(6), 15 Mar. 1990, pages 2704–2710. The $Cs^+$- source solid electrolyte comprises a cesium-mordenite solid electrode which is sandwiched between a porous tungsten emitting electrode and a nonporous platinum electrode. A combination of an applied voltage and heat enables $Cs^+$ ions to be emitted. Further details of the solid electrolyte cesium source can be found in "The Theory of Metal-Solid Electrolyte Interface", Materials Research Society Symposium Proceedings, vol. 135, pages 95–100 and in U.S. Pat. No. 4,783,595.

The Kim et al. cesium ion source, in ion gun form, has been used for ion beam sputter deposition of gold, copper, molybdenum, tungsten and tantalum. The cesium particles from the solid-state cesium ion gun pass through a pair of deflecting plates which cause the cesium ion beam to be directed towards a target that lies to one side of the center line of the ion gun and not in its direct path. A substrate positioned opposite the target, and on the other side of the center line of the ion gun, receives the sputtered molecules that are liberated from the target as a result of the cesium bombardment. (See "Solid-State Cesium Ion Gun for Ion Beam Sputter Deposition" Kim et al., Review of Scientific Instruments, vol. 63 (no.12), December 1992, pages 5671–5673.)

Pargellis et al. in "Sputtering Negative Carbon Ions From Cesiated Graphite Surfaces" Journal of Vacuum Science Technology A1(3), July/September 1983, pages 1388–1393, describe a system for sputtering of negative carbon ions from graphite targets that are bombarded with cesium ions. Pargellis et al. bombarded a graphite block from a source of cesium atoms piped into the ion beam generation region from a cesium oven. The bombardment of the graphite target by the positive cesium ions causes generation of negative carbon ions. Few details are given regarding the specific arrangement of the cesium ovens and the various ion beam extraction electrodes.

Ion beam deposition has many benefits when compared with chemical vapor deposition. Ion beam deposition procedures enable room temperature deposition. The deposition rate of metal negative ions is not effected by temperature. Little or no sample surface preparation is required and the procedure employs no hydrogen in the ion beam atmosphere. The deposition rate from a focused negative ion beam can be as great as 100 microns per hour. In general, vapor phase prior art deposition procedures have not enabled metal ions to be deposited over large deposition areas.

SUMMARY OF THE INVENTION

A negative ion beam source includes a heated refractory metal ribbon which is positioned adjacent a beam forming electrode that is, in turn, biased to cause emission of a positive ions from the metal ribbon. An extraction electrode is juxtaposed to the beam forming electrode and includes an aperture for passing a beam of positive ion generated by the metal ribbon. The extraction electrode includes a cesium chamber with openings that are directed towards the refractory metal ribbon. A heater heats the cesium chamber and causes it to expel cesium neutrals towards a surface of the refractory metal ribbon where the cesium neutrals are ionized to positively charged cesium ions. A target is displaced to one side of a perpendicular from the surface of the refractory metal ribbon and is positioned adjacent a negative ion beam forming electrode that is biased to attract the cesium ion beam and to cause emission of negative ions produced by cesium ion bombardment of the target. A negative ion extraction electrode is positioned to another side of the perpendicular line and is biased to repel the cesium ion beam and to attract and pass negative ions formed by bombardment of the target.

DETAILED DESCRIPTION OF THE INVENTION

Figure 1:
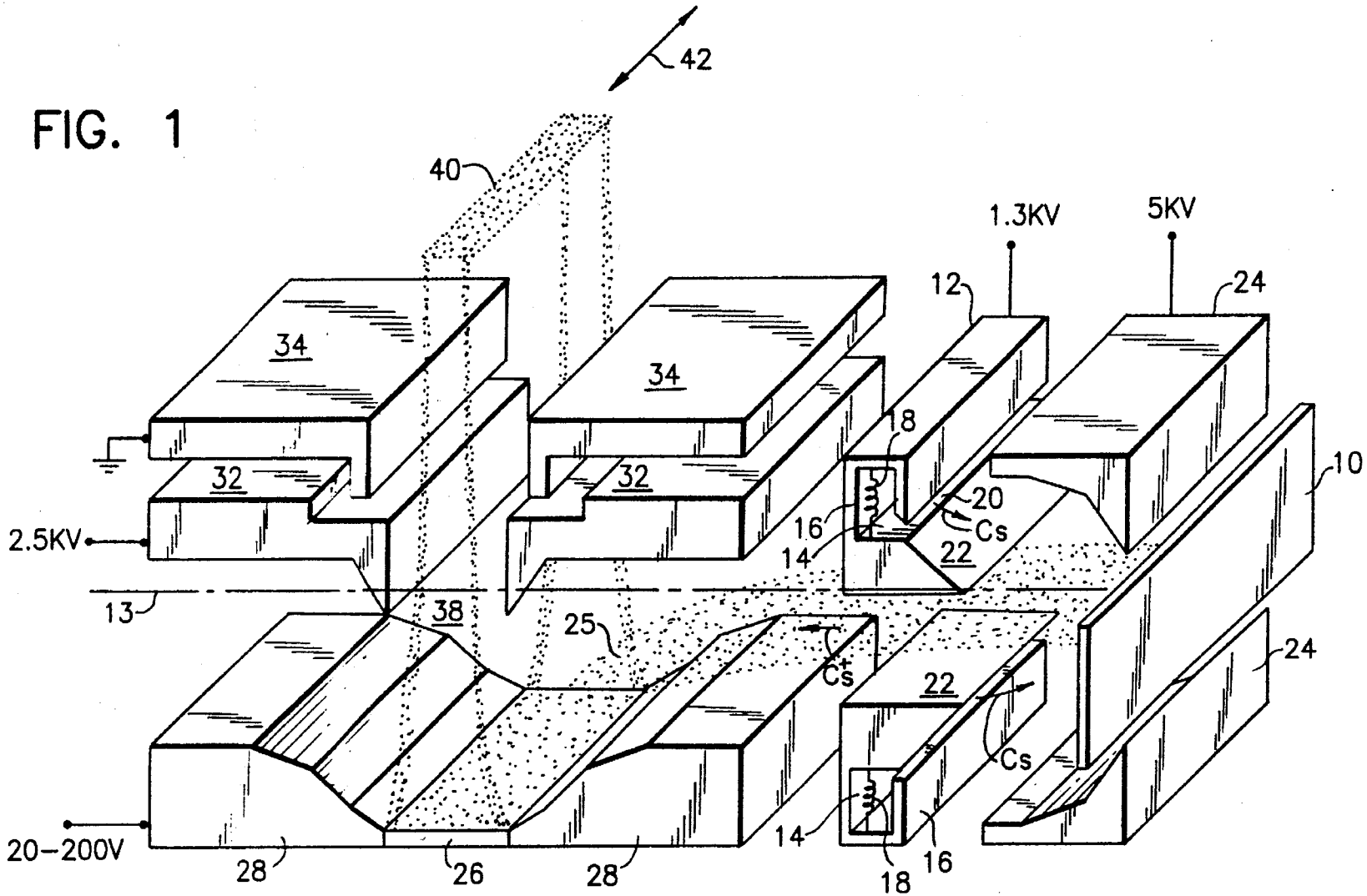
FIG. 1 is a schematic, perspective view of a negative ion beam source that incorporates the invention hereof.
Figure 2:
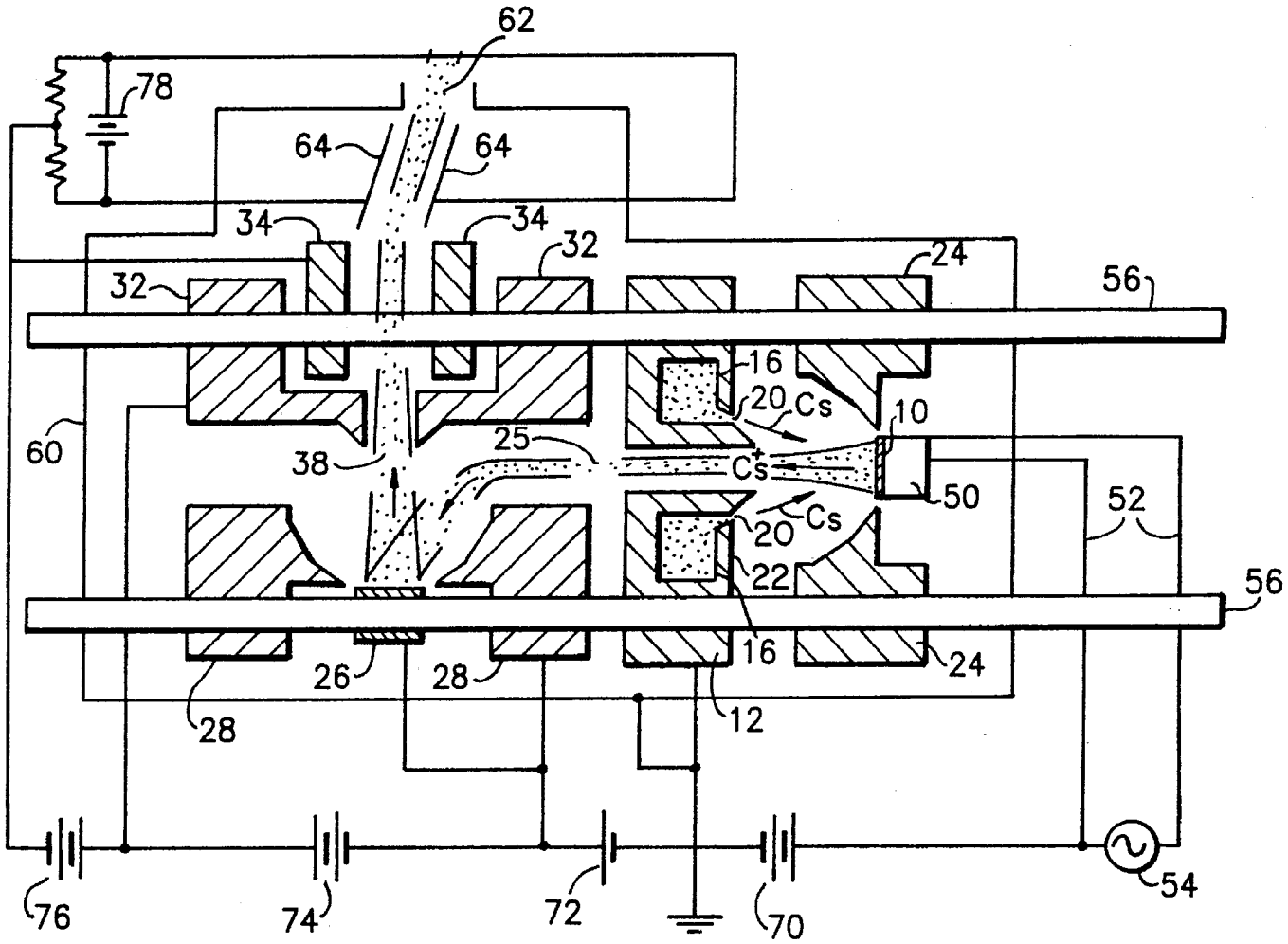
FIG. 2 is a side sectional view of a negative ion beam source constructed in accordance with the invention.

Both FIG. 1 and FIG. 2 illustrate the invention, however, the electrode structures shown in FIG. 1 have been somewhat simplified to enable a clear understanding of the linear dimensionality of the invention. Further, each of the electrode structures comprises two opposed electrode members, each of which is a mirror image of the other and each of which is biased identically. As will be further understood, the structure of the negative ion beam source may be extended linearly to achieve a large rectilinear deposition pattern on a substrate.

Referring to FIG. 1, a refractory metal ribbon 10 (preferably tungsten) is heated to a high temperature (e.g. 1200° C.) by an attached AC power supply (not shown in FIG. 1). A cesium extraction electrode pair 12 is positioned equidistantly about a perpendicular 13 drawn from the surface of refractory metal ribbon 10. Within each electrode arm of cesium extraction electrode pair 12 is positioned a cesium source 14 which is housed in rectilinear box 16. A heater 18 is present in each box 16 and is independently controllable to vaporize the cesium and to increase the vapor within boxes 16.

Each box 16 includes an opening 20 which mates with an opening in each of opposed electrode members 12 and provides an exit pathway for a cesium neutral flux which is emitted when the temperature in box 16 is elevated. Opening 20 enables the cesium neutral flux to pass over pedestal portions 22 of electrode members 12 and to be directed towards refractory metal ribbon 10. Upon reaching ribbon 10, the cesium neutral flux is ionized and is converted to a cloud of positively charged $Cs^+$ ions.

A beam forming electrode pair 24 is biased to a high positive voltage and acts to enable emission of the positively charged $Cs^+$ ions. Extraction electrode pair 12 is biased to a lower positive voltage, extracts the $Cs^+$ ions from the region of refractory metal ribbon 10 and creates a $Cs^+$ ion beam 25. A metal target 26 is positioned between a metal ion beam forming electrode pair 28 that is biased to an even lower positive voltage than is extraction electrode pair 12.

Metal ion beam forming electrode pair 28 and metal target 26 are positioned to one side of perpendicular line 13 whereas a metal ion extraction electrode pair 32 and an energy control electrode pair 34 are positioned to the other side of perpendicular line 13. Metal ion extraction electrode pair 32 is biased substantially positive with respect to metal ion beam forming electrode pair 28 and acts to deflect cesium ion beam 25 towards metal target 26.

The bombardment of the $Cs^+$ ion flux onto target 26 causes generation of a cloud of negative metal ions. Those negative metal ions are attracted through aperture 38 by the action of an extraction potential applied to metal ion extraction electrode pair 32.

Energy control electrode 34 is connected to a source of reference potential and controls the energy of the negative metal ions. Deposition energy is the potential difference between metal target 26 and the substrate (not shown) on which deposition is occurring (usually ground). Energy control electrode pair 34 reduces the energy of the metal ion beam prior to its further deflection and deposition on a substrate. Cross-section 40 of the negative metal ion beam indicates its rectangular shape, which is extendable in the direction shown by arrows 42, depending upon the linear dimensions of the operating electrode pair.

Referring to FIG. 2, a more detailed description of the negative ion beam source will be provided. Refractory metal ribbon 10 is mounted on a molybdenum block 50. A pair of conductors 52 connect refractory metal ribbon 10 to an AC source 54 which provides heater power therefor. Refractory metal ribbon 10 is equidistantly placed between cesium beam forming electrode pair 24 which, together with cesium extraction electrode pair 12, produce a rectilinear positive $Cs^+$ ion beam 25. $Cs^+$ ion beam forming electrode pair 24 includes three different slopes which act to define the convergent $Cs^+$ beam. Cesium beam forming electrode pair 24 is designed in accordance with the principles defined by Pierce ("Theory and Design of Electron Beams", (Van Nostrand) pp. 173–193 and chapter 10).

A pair of ceramic rods 56 position and support the various electrodes and parts of the negative ion beam source. Ceramic rods 56 are electrically insulating, are hollow, and include tungsten wire heaters therein. If electrical leakage is determined as a result of cesium deposition on rods 56, the heaters (not shown) may be energized to desorb the $Cs^+$ ions that have been adsorbed thereon.

As indicated above, cesium extraction electrode pair 12 provides both an extraction function for $Cs^+$ ion beam 25 and act as a source of cesium neutrals that are directed towards refractory metal ribbon 10. The vapor pressure within each box 16 is temperature controlled, which vapor pressure, in turn, controls the amount and velocity of cesium neutrals which are directed through openings 20 towards refractory metal ribbon 10. The slanted portions of pedestals 22 provide a directing function for the cesium neutrals and insure that the cesium neutrals cover the entire width of refractory metal ribbon 10.

Upon impacting on the surface of refractory metal ribbon 10, the cesium neutrals are ionized and create a $Cs^+$ cloud from which the $Cs^+$ ions are formed into beam 25 by extraction electrode pair 12. Ion beam 25 is substantially rectangular in shape and is directed by the potentials impressed on metal ion beam forming electrode pair 28 and metal ion extraction electrode pair 32 to impact upon metal target 26. Metal target 26 is thereby sputtered by impact of the $Cs^+$ ions and creates a high yield of negatively charged target metal ions. The negative ion yield is defined by the ratio of primary cesium ion current to a secondary metal ion current. Negative ion yields in the range of 0.1–0.5 are achievable through the use of this structure.

Metal ion extraction electrode pair 32 is biased to attract the negative metal ions that are sputtered from target 26 and causes them to pass through aperture 38 and energy control electrode pair 34.

The entire negative ion beam source is contained within a housing 60 which is provided with an exit aperture 62. Positioned between exit aperture 62 and energy control electrode pair 34 are a pair of deflecting plates 64 which are biased to deflect the negative metal ion beam towards aperture 62, as the ion beam passes from between energy control electrode pair 34. Deflection plates 64 perform a further function of preventing cesium neutrals from exiting through aperture 62. The cesium neutrals that are entrained in the metal ion beam are not affected by the deflecting voltage applied to deflecting plates 64 and tend to impact thereupon. Further, deflecting plates 64 can be water cooled (not shown) to assure condensation of the cesium neutrals thereupon. In this manner, cesium neutrals do not escape from the negative ion beam source and affect the quality of a resulting deposited film.

It is preferred that box 60 be heated to a temperature approximately 300°–400° C. so as to provide a high cesium vapor pressure within its interior. Exit aperture 62 and a portion of the box surrounding it may be water cooled to enable whatever cesium neutrals that escape from deflection plates 64 to deposit thereupon. Exit aperture 62 is electrically grounded and functions as a final energy reducing electrode for the negative metal ion beam.

Various voltage supplies are employed to control the operation of the negative ion beam source. "High voltage supply 70 provides a positive high voltage in the range of 5–10 kV for application to beam forming electrode pair 24.

A relatively low voltage source 72 (00–200 eV) is applied to metal ion beam forming electrode pair 28 and determines the actual deposition energy of the metal ion beam. The potential applied by source 72 is not sufficient to substantially affect the trajectory of cesium ion beam 25.

DC source 74 is a high voltage supply (5–10 kV) that is applied between extraction electrode pair 32 and metal ion beam forming electrode pair 28. In addition to enabling metal ion beam extraction, potential 74 also acts to deflect the cesium ion beam towards target 26. A high voltage DC source 76 is applied between energy control electrode pair 34 and metal ion extraction electrode pair 32. This potential reduces the energy of the negative metal ion beam and is approximately half of the extraction potential. Power supply 78 provides the necessary voltage for deflecting plates 64.

As indicated above, the negative ion beam source shown in FIGS. 1 and 2 can provide a variety of metal ion beams, including carbon, gold, silver, platinum, aluminum, chromium, tungsten, tantalum, molybdenum, etc. One preferred application of the invention is for the deposition of wear resistant coatings, including diamond-like films created by use of a carbon target. The negative ion beam source is sufficiently small that it can be utilized to coat cylindrical inner surfaces and can also be utilized to provide continuous sheet coating of wide area substrates.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

I claim:

1. A negative ion beam source including an ion beam path and comprising:

rectilinear heated ribbon means positioned at an end of said ion beam path;

first beam forming electrode means positioned about said heated ribbon means and biased to cause emission of positively charged ions in a downstream direction along said ion beam path;

first extraction electrode means positioned downstream along said ion beam path from said rectilinear heated ribbon means and having an aperture for passage of a beam of positively charged ions, and further including cesium chamber means with at least one opening directed upstream along said ion beam path towards said rectilinear heated ribbon means;

heater means for heating said cesium chamber means to cause an expulsion upstream along said ion beam path of cesium neutral species towards a surface of said rectilinear heated ribbon means, said cesium neutral species, upon contact with said surface of said rectilinear heated ribbon means, converted to $Cs^+$ ions, said $Cs^+$ ions acted upon by said first beam forming electrode means and first extraction electrode means to create a $Cs^+$ ion beam traveling in said downstream direction;

a target;

second beam forming electrode means positioned along said ion beam path and biased to enable emission of negative ions which are produced when said target is bombarded by said $Cs^+$ ion beam; and second extraction electrode means positioned along said ion beam path and biased to direct said $Cs^+$ ion beam towards said target and to attract negative target ions emitted from said target and to form said negative target ions into a negative ion beam.

2. The negative ion beam source as recited in claim 1, wherein said target is displaced to one side of a perpendicular drawn from said surface of said rectilinear heated ribbon means and said second extraction electrode means is positioned at another side of said perpendicular line.

3. The negative ion beam source as recited in claim 1, wherein said cesium chamber means is positioned within said first extraction electrode means and communicates with second aperture means therein to direct a flow of cesium neutral species towards said rectilinear heated ribbon means, upon action of said heater means.

4. The negative ion beam sources as recited in claim 1, wherein said first beam forming electrode means comprises a pair of elongated conductive electrodes, each one of said elongated conductive electrodes containing a cesium chamber means and having an aperture for passage of cesium neutral species towards said rectilinear heated ribbon beams.

5. The negative ion beam source as recited in claim 4, wherein each of said pair of elongated conductive electrodes is in the form of an approximate L-shape, with bottom legs of each L-shape oppositely disposed to create said aperture for passage of the $Cs^+$ ion beam, each said bottom leg having a slanted portion to cause said bottom leg to terminate in a sharp edge that is oriented towards said rectilinear heated ribbon means.

6. The negative ion beam source as recited in claim 1, wherein said rectilinear heated ribbon means is comprised of a refractory metal, is shaped as an elongated planar-shaped rectangle and is positioned between opposed electrodes of said first extraction electrode means.

7. The negative ion beam source as recited in claim 1, further comprising:

energy control electrode means positioned adjacent said second extraction electrode means for altering an energy content of said negative ion beam.

8. The negative ion beam source as recited in claim 1, further comprising;

deflector plate means positioned in a path taken by said negative ion beam, said deflector plate means biased to deflect negative target ions towards an aperture and further positioned to intercept cesium neutral species which accompany said negative ion beam.

* * * * *